US007712532B2

(12) United States Patent
Walton

(10) Patent No.: US 7,712,532 B2
(45) Date of Patent: May 11, 2010

(54) ENERGIZED FLUIDS AND PRESSURE MANIPULATION FOR SUBSURFACE APPLICATIONS

(75) Inventor: Ian C. Walton, Frisco, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 210 days.

(21) Appl. No.: 11/958,690

(22) Filed: Dec. 18, 2007

(65) Prior Publication Data

US 2009/0151952 A1 Jun. 18, 2009

(51) Int. Cl.
*E21B 29/04* (2006.01)
*E21B 43/119* (2006.01)
*E21B 43/25* (2006.01)

(52) U.S. Cl. ..... 166/298; 166/55.1; 166/164; 166/169; 166/305.1; 166/312

(58) Field of Classification Search ..... None
See application file for complete search history.

(56) References Cited

U.S. PATENT DOCUMENTS 2,029,478 A 2/1936 Haines
2,699,832 A * 1/1955 Allen ..... 166/304
3,913,672 A * 10/1975 Allen et al. ..... 166/402
3,937,283 A 2/1976 Blauer et al.
3,954,141 A * 5/1976 Allen et al. ..... 166/403
4,007,785 A * 2/1977 Allen et al. ..... 166/272.1
4,605,074 A 8/1986 Barfield
4,903,775 A 2/1990 Manke
6,192,985 B1 2/2001 Hinkel et al.
6,527,050 B1 3/2003 Sask
6,550,538 B1 4/2003 Herrmann et al.
6,554,081 B1 4/2003 Brooks et al.
6,598,682 B2 7/2003 Johnson et al.
6,732,798 B2 5/2004 Johnson et al.
6,874,579 B2 4/2005 Johnson et al.
6,966,377 B2 11/2005 Johnson et al.
7,121,340 B2 10/2006 Grove et al.
7,182,138 B2 * 2/2007 Behrmann et al. ..... 166/311

(Continued)

FOREIGN PATENT DOCUMENTS

GB 2432859 A 6/2007

(Continued)

OTHER PUBLICATIONS

Bakker, Eelco; Veeken, Kees; Behrmann, Larry; Milton, Phil; Stirton, Gary; Salsman, Alan; Walton, Ian; Stutz, Lloyd; Underdown, David; "The New Dynamics of Underbalanced Perforating"; Oilfield Review; Winter 2003-2004; pp. 54-67.

(Continued)

*Primary Examiner*—George Suchfield
(74) *Attorney, Agent, or Firm*—Rodney V. Warfford; Kevin B. McGoff; Winstead Sechrest & Minick

(57) ABSTRACT

Method and system for use in a subsurface formation traversed by a wellbore. An energized fluid, which when subjected to a low pressure environment liberates or releases gas from solution, is disposed in the formation. Reduced pressure in a region of the wellbore below pressure in the surrounding formation liberates a gas in the energized fluid near a tunnel created in the formation.

10 Claims, 4 Drawing Sheets

U.S. PATENT DOCUMENTS

| | | | | |
|---|---|---|---|---|
| 7,243,725 | B2 | 7/2007 | George et al. | |
| 7,284,612 | B2 | 10/2007 | Ratanasirigulchai et al. | |
| 7,287,589 | B2 | 10/2007 | Grove et al. | |
| 2004/0099418 | A1 * | 5/2004 | Behrmann et al. | 166/312 |
| 2005/0045334 | A1 | 3/2005 | Hayes | |
| 2005/0167108 | A1 | 8/2005 | Chang et al. | |
| 2006/0166836 | A1 | 7/2006 | Pena et al. | |
| 2006/0178276 | A1 | 8/2006 | Pena et al. | |
| 2007/0107897 | A1 | 5/2007 | Dahanayake et al. | |
| 2007/0215355 | A1 | 9/2007 | Shapovalov et al. | |
| 2007/0235189 | A1 | 10/2007 | Milne et al. | |
| 2007/0238624 | A1 | 10/2007 | Li et al. | |
| 2007/0249505 | A1 | 10/2007 | Dahayanake et al. | |
| 2008/0202757 | A1 | 8/2008 | Wilson | |

FOREIGN PATENT DOCUMENTS

| | | | |
|---|---|---|---|
| WO | 0037777 | A1 | 6/2000 |
| WO | 0065196 | A1 | 11/2000 |

OTHER PUBLICATIONS

Minto, D.; Falxa, P.; Manalu, D.; and Simatupang, M.; "Dynamic Underbalanced Perforating System Increases Productivity and Reduces Cost in East Kalimantan Gas Field; A Case Study"; Presentation at SPE/IADC Middle East Drilling Technology Conference & Exhibition, Dubai, U.A.E.; Sep. 12-14, 2005; SPE/IADC #97363;pp. 1-8.

* cited by examiner

ENERGIZED FLUIDS AND PRESSURE MANIPULATION FOR SUBSURFACE APPLICATIONS

BACKGROUND

1. Technical Field

This invention relates generally to the field of subsurface reservoir communication with a wellbore.

2. Description of Related Art

To complete a well, one or more subsurface formation zones adjacent a wellbore are perforated to allow gaseous and liquid hydrocarbons from the formation zones to flow into the well for production to the surface or to allow injection fluids to be applied into the formation zones. A perforating gun string may be lowered into the well and the guns fired to penetrate metal casing, cement, or other materials in the wellbore, and to extend perforations into the surrounding formation.

The explosive nature of the penetration of perforation tunnels comminutes the adjacent rock, fractures sand grains, dislodges intergrain cementation, and debonds clay particles, resulting in a low-permeability "shock damaged region" surrounding the tunnels. The process may also generate a tunnel full of rock debris mixed in with the perforator charge debris. FIG. 1 shows a typical perforation tunnel created in a subsurface formation. The wellbore 10 is shown including casing 12 and a layer of cement 14. A shock damaged region 16 surrounds the perforation tunnel 18. The extent of the damage, and the amount of loose debris in the tunnel, may be dictated by a variety of factors including formation properties, explosive charge properties, pressure conditions, fluid properties, and so forth. The shock damaged region 16 and loose debris in the perforation tunnels negatively impacts hydrocarbon production.

One popular method of obtaining cleaner perforations is underbalanced perforating. The perforation is carried out with a lower wellbore pressure than the formation pressure. Underbalanced perforating and wellbore pressure control techniques are described in D. Minto et al., *Dynamic Underbalanced Perforating System Increases Productivity and Reduces Cost in East Kalimantan Gas Field: A Case Study*, SPE/IADC 97363 (2005); Eelco Bakker et al., *The New Dynamics of Underbalanced Perforating*, Oilfield Review, Winter 2003/2004, at 54; and U.S. Pat. Nos. 7,243,725, 4,605,074, 6,527,050, 4,903,775. Though advances have been made, conventional perforation techniques remain limited by the reservoir pressure and relatively ineffective in low-pressure reservoirs.

A need remains for techniques to improve reservoir communication with wells in subsurface formations.

SUMMARY

One aspect of the invention provides a method for use in a subsurface formation traversed by a wellbore. The method includes disposing an energized fluid in the formation; and reducing pressure in a region of the wellbore below pressure in the surrounding formation to liberate a gas in the energized fluid near a tunnel created in the formation.

Another aspect of the invention provides a method for use in a subsurface formation traversed by a wellbore. The method includes disposing an energized fluid in the formation; creating a tunnel in the formation at a region in the wellbore; and reducing pressure in the wellbore region to below pressure in the surrounding formation to liberate a gas in the energized fluid near the tunnel.

Another aspect of the invention provides a method for use in a subsurface formation traversed by a wellbore. The method includes creating a tunnel in the formation at a region in the wellbore; disposing an energized fluid in the formation near the tunnel; reducing pressure in the wellbore region to below pressure in the surrounding formation to liberate a gas in the energized fluid near the tunnel.

Another aspect of the invention provides a system for a subsurface formation traversed by a wellbore. The system includes an energized fluid contained for disposal in the formation; and an apparatus to reduce pressure in a region of the wellbore below pressure in the surrounding formation to liberate a gas in the energized fluid near a tunnel created in the formation.

BRIEF DESCRIPTION OF THE DRAWINGS

Other aspects and advantages of the invention will become apparent upon reading the following detailed description and upon reference to the drawings in which like elements have been given like numerals and wherein.

DETAILED DESCRIPTION

Figure 1:
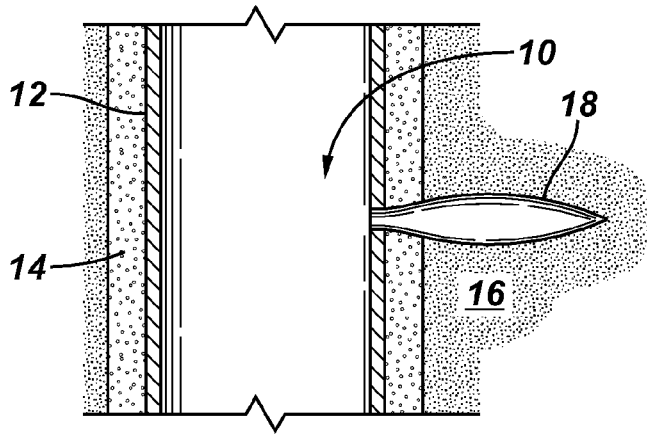
FIG. 1 illustrates a perforation tunnel formed in a subsurface formation.

The present invention involves the disposal into the wellbore and formation matrix of an energized fluid so that on application of a local low pressure condition in the wellbore, gas is released from solution to remove perforation damage caused by a perforating event. For purposes of this disclosure, the term "energized fluid" is understood to comprise a fluid which when subjected to a low pressure environment liberates or releases gas from solution (for example, a liquid containing dissolved gases) as known in the art. Aspects of the invention include energized fluids comprising any of:

(a) Liquids that at bottom hole conditions of pressure and temperature are close to saturation with a species of gas. For example the liquid can be aqueous and the gas nitrogen. Associated with the liquid and gas species and temperature is a pressure called the bubble point, at which the liquid is fully saturated. At pressures below the bubble point, gas emerges from solution;

(b) Foams, consisting generally of an aqueous phase and a gas phase. At high pressures the foam quality is typically low (i.e., the non-saturated gas volume is low), but quality (and volume) rises as the pressure falls; or (c) Liquefied gases.

Fluid technologies incorporating a gaseous component or a supercritical fluid to form an energized fluid are described in U.S. Pat. Nos. 2,029,478, 3,937,283, 6,192,985 and U.S. Patent Publication Nos. 20060178276, 20060166836, 20070238624, 20070249505, 20070235189, 20070215355, 20050045334 and 20070107897. Typical gas components comprise a gas selected from the group consisting of nitrogen, air, argon, carbon dioxide, helium, krypton, xenon, and any mixtures thereof. The energized fluids that may be used within aspects of the invention include any stable mixture of gas phase and liquid phase.

According to aspects of the invention, a combination of wellbore pressure manipulation and energized fluid is used to mitigate or remove perforation damage. Pressure in a wellbore region or interval is manipulated in relation to the reservoir pressure to achieve removal of debris from perforation tunnels. The pressure manipulation aspects include creation of an underbalance condition (the wellbore pressure being lower than formation pressure) during and/or post-perforation. Creation of an underbalance condition can be accomplished in a number of different ways, such as by use of a low pressure chamber that is opened to create a dynamic underbalance condition, the use of empty space in a perforating gun to draw pressure into the gun right after firing of shaped charges, and other techniques that can be applied before, during, or post-perforation. Such techniques are described in U.S. Pat. Nos. 6,598,682, 6,732,798, 7,182,138, 6,550,538, 6,874,579, 6,554,081, 7,287,589, 7,284,612, 6,966,377, 7,121,340 and U.S. Patent Publication No. 20050167108 (all assigned to the present assignee and entirely incorporated herein by reference).

On application of an underbalance, the pore pressure surrounding the perforation tunnel drops (typically by several thousand psi) below the bubble point if the energized fluid contains gas in solution, thereby liberating free gas that rapidly expands in volume as the pressure falls. In aspects of the invention wherein the energized fluid is foam, its quality increases as the pressure falls, exhibiting a rapid increase in free-gas volume. In aspects wherein the energized fluid is a liquefied gas, the drop in pressure will again liberate a quantity of gas.

This rapid increase in free-gas volume serves two purposes. First, it breaks or weakens the bonding between the sand grains in the damaged zone surrounding the perforation tunnel and second, the release of the gas combined with the drop in wellbore pressure generates a flow of liquid and gas into the wellbore that serves to remove any failed material. The emergence and expansion of the gas in the energized fluid improves its performance, particularly its ability to carry away solids within the tunnels to clear pathways through which oil or gas can be produced. The net result is removal of the damaged material, leading ultimately to improved well productivity.

The energized fluid may be disposed into the reservoir before perforating the well (e.g., as part of the drilling fluid, before casing) or after perforating. In some aspects of the invention, injection of the energized fluid is performed by use of an applicator tool, described further below. A local dynamic underbalance condition can be created by use of a chamber containing a relatively low fluid pressure. For example, the chamber may be a sealed chamber containing a gas or other fluid at a lower pressure than the surrounding wellbore/formation environment. As a result, when the chamber is opened, a sudden surge of fluid flows into the lower pressure chamber to create the local low pressure condition in a wellbore region in communication with the opened chamber.

In some implementations, the chamber is a closed chamber that is defined in part by a closure member located below the surface of the well. In other words, the closed chamber does not extend all the way to the well surface. For example, the closure member may be a valve located downhole. Alternatively, the closure member may be a sealed container having ports that include elements that can be shattered by some mechanism (such as by the use of an explosive or some other mechanism). The closure member may comprise other types of devices in other implementations.

In one aspect of the invention, a sealed atmospheric container is lowered into the wellbore after a formation has been cased and perforated. After the energized fluid is disposed in the formation, openings are created (such as by use of explosives, valves, or other mechanisms) in the housing of the container to generate a sudden underbalance condition, causing gas liberation in the energized fluid and a fluid surge to remove damaged formation particles and debris from the perforation tunnels.

Figure 2:
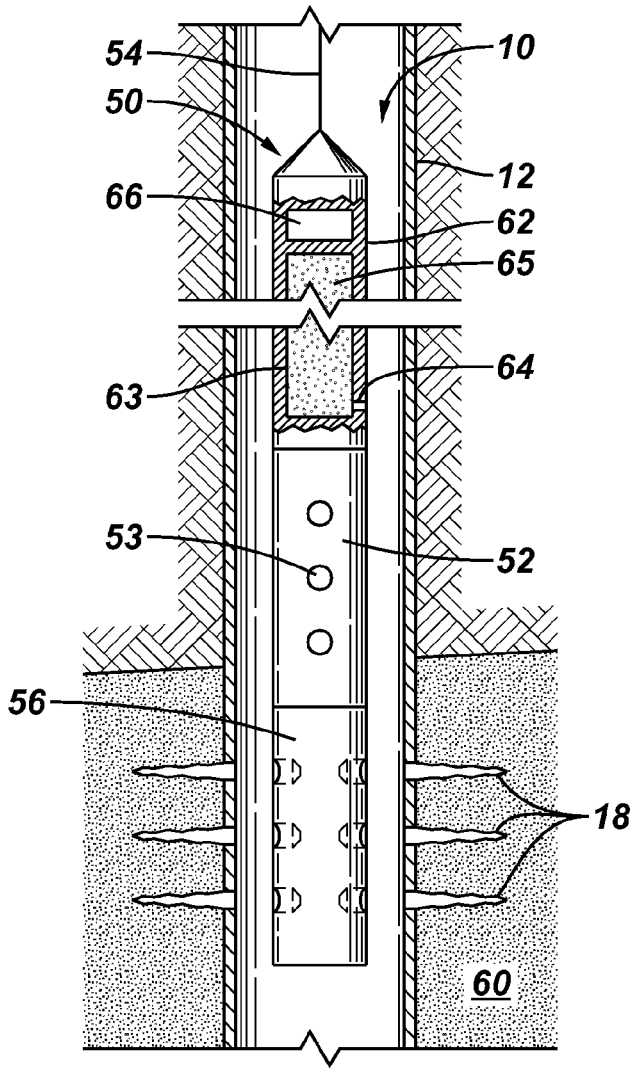
FIG. 2 is a schematic of a system including a tool for disposing energized fluid and a tool to create a local underbalance condition in a wellbore, in accordance with aspects of the invention.

FIG. 2 shows a system 50 according to the invention. The system 50 includes various tools or apparatus, which are run to a desired depth in the wellbore 10 on a carrier line 54 (e.g., coiled tubing, wireline, slickline, etc.). In this aspect, the system 50 includes a perforating gun 56 that is operable to perforate though the casing 12 to create tunnels 18 in the formation 60 surrounding a wellbore region. The perforating gun 56 can be activated by various mechanisms, such as by a signal communicated over an electrical conductor, a fiber optic line, a hydraulic control line, or other types of channels as known in the art.

The system 50 further includes an applicator tool 62 for disposing the energized fluid into the formation 60. The applicator tool 62 may include a pressurized chamber 63 containing the energized fluid 65. Upon opening of a port 64, the pressurized energized fluid 65 in the chamber 63 is communicated into the wellbore 10 and surrounding formation 60. Alternatively, the applicator tool 62 may be in communication with a fluid conduit that extends to the well surface or another section in the wellbore above the system 50 (not shown). The energized fluid is then applied down the fluid conduit to the applicator tool 62 and through the port 64 to flow into the formation. The fluid conduit for the energized fluid can be extended through the carrier line 54. Alternatively, an energized fluid conduit may run external to the carrier line 54 (not shown).

In some aspects of the invention, the applicator tool 62 can be designed to provide more than one type of energized fluid to the formation. In one implementation, the applicator tool 62 can include multiple chambers for storing different types of energized fluids. Alternatively, multiple fluid conduits can be provided to dispose multiple types of energized fluids into the formation. In some aspects, the system 50 may include a time release mechanism 66 to control disposal of the energized fluid 65. With such implementations, the rate of dispensing the energized fluid may be selected to achieve optimal performance.

In the aspect shown in FIG. 2, a surge tool 52 is disposed in the wellbore 10 to create a local dynamic underbalance condition. The surge tool 52 includes one or more ports 53 that are selectively opened to enable communication with an inner, lower pressure chamber inside the surge tool 52. The ports 53 can be actuated open by use of a valve, an explosive, or some other mechanisms. Various mechanisms can be used to provide the low pressure in the chamber of the surge tool 52. For example, a tubing or control line can be used to establish the low pressure.

In another aspect of the invention, the dynamic underbalance can be generated during perforation. In such implementations, the energized fluid is disposed in the formation prior to perforation (e.g., prior to casing the well). The applicator tool 62 or another apparatus may be used to inject the energized fluid(s). After disposal of the energized fluid in the formation, the perforating gun 56 is fired to coincide substantially with activation of the surge tool 52 to create the local underbalance condition. This liberates gas in the energized fluid 65 in the wellbore 10 and formation tunnel 18, which rapidly expands in volume as the pressure falls, causing a flow of fluid and debris out of the perforation tunnels into the wellbore such that cleanup of the perforation tunnels is achieved. As with all implementations of the invention, further operations such as fracturing and/or gravel packing can then be performed as known in the art.

In another aspect of the invention, a chamber within the gun 56 can be used as a sink for wellbore fluids to generate the underbalance condition. Following charge combustion, hot detonation gas fills the internal chamber of the gun 56. If the resultant detonation gas pressure is less than the wellbore pressure, then the cooler wellbore fluids are sucked into the gun 56 housing. The rapid acceleration through perforation ports in the gun 56 housing breaks the fluid up into droplets and results in rapid cooling of the gas. Hence, rapid gun pressure loss and even more rapid wellbore fluid drainage occurs, which generates a drop in the wellbore (and therefore in the surrounding formation) pressure. The drop in wellbore pressure creates an underbalance condition, causing gas liberation in the energized fluid and fluid surge out of the perforation tunnels 18.

Various apparatus can be used to create the surge for generating the dynamic underbalance condition and for perforating the formations. Apparatus that can be used to implement aspects of the invention include the tools and systems described in U.S. Pat. Nos. 6,598,682, 6,732,798, 7,182,138, 6,550,538, 6,874,579, 6,554,081, 7,287,589, 7,284,612, 6,966,377, 7,121,340 and U.S. Patent Publication No. 20050167108. These tools/systems can be used to replace components and/or in combination with the components of the aspects disclosed herein.

Figure 3:
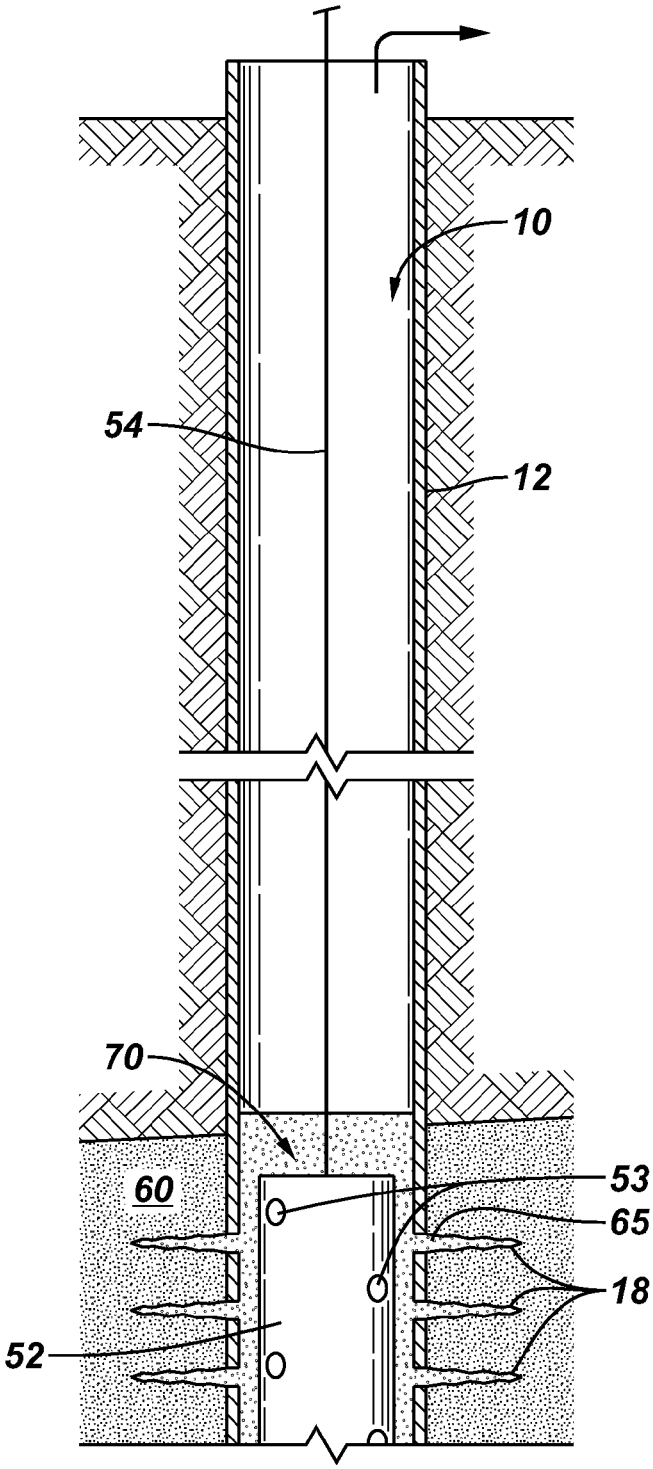
FIG. 3 is a schematic of a system including a tool to create a local underbalance condition in a wellbore in accordance with aspects of the invention.

FIG. 3 shows another system 70 of the invention including another aspect of a surge tool 52 comprising a sealed atmospheric container (or container having an inner pressure that is lower than an expected pressure in the wellbore in the interval of the formation) disposed in a wellbore 10 (which is lined with casing 12) and placed adjacent a perforated formation 60. The tool string is lowered on a carrier line 54 (e.g., wireline, slickline, coiled tubing, etc.). The surge tool 52 includes a chamber that is filled with a gas (e.g., air, nitrogen) or some other suitable fluid. The tool 52 has multiple ports 53 that can be selectively opened or exposed.

Figure 4:
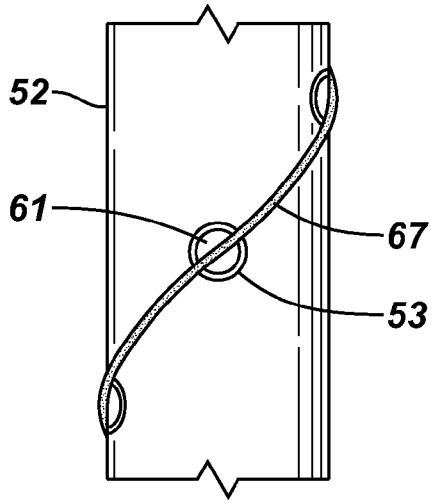
FIG. 4 is a more detailed schematic of the tool of FIG. 3.

As shown in FIG. 4, the ports 53 may include openings that are plugged with sealing elements 61. An explosive, such as a detonating cord 67, is placed in the proximity of each of the ports 53. Activation of the detonating cord 67 causes the sealing elements 61 to shatter or break away from corresponding ports 53. Additional description of this system is found in U.S. Pat. No. 7,182,138, assigned to the present assignee.

In an aspect of the invention, after perforations 18 in the formation 60 have been formed and the energized fluid 65 has been disposed in the formation 60, the atmospheric chamber in the tool 52 is explosively opened to the wellbore. The sudden drop in pressure inside the wellbore 10 will liberate gas from the energized fluid 65 and cause fluid and gas from the perforated tunnels 18 to rush into the empty space left in the wellbore by the tool 52. This flow serves to remove any failed material, leaving clean formation tunnels 18. The energized fluid(s) can be disposed in the formation by any suitable means (such as the applicator tool 62 of FIG. 2) prior to opening of the atmospheric chamber of the tool 52. This implementation can be used with or without a perforating gun.

Figure 5:
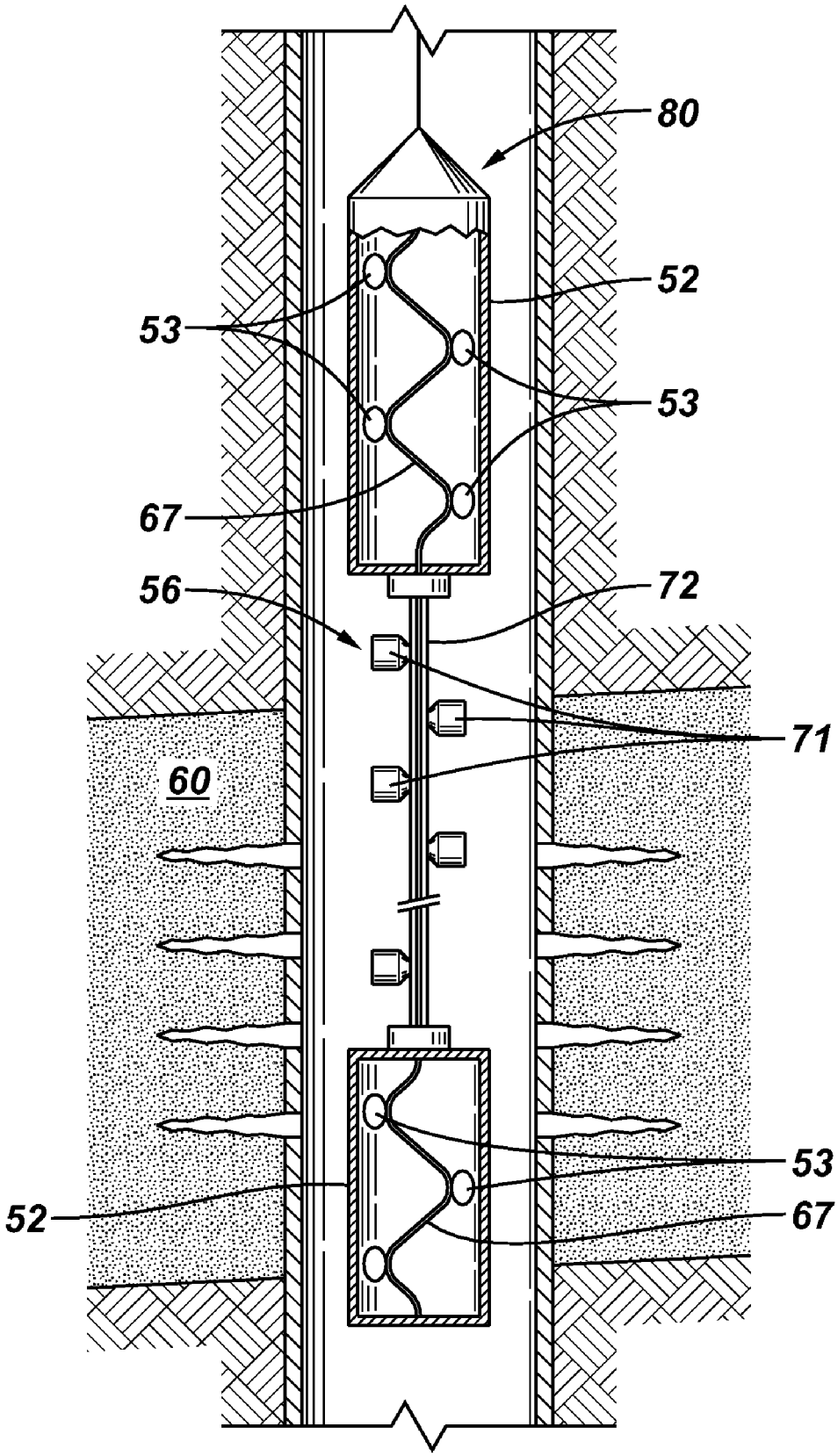
FIG. 5 is a schematic of a system including tools for creating an underbalance condition in a wellbore and for perforating a formation in accordance with aspects of the invention.

If used with a perforating gun, activation of the perforating gun may substantially coincide with opening of the ports 53. Such an implementation provides for underbalanced perforating. FIG. 5 shows another system 80 of the invention. This aspect includes another surge tool 52 comprising atmospheric containers in conjunction with a perforating gun 56. The tool 52 is divided into two portions, a first portion above the perforating gun 56 and a second portion below the perforating gun. The tool 52 containers include various ports 53 that are adapted to be opened by an explosive force, such as an explosive force due to initiation of a detonating cord 67 or detonation of explosives connected to the detonating cord. The detonating cord 67 is also connected to shaped charges 71 on the perforating gun 56. In one aspect, as illustrated, the perforating gun 56 can be a strip gun, in which capsule shaped charges 71 are mounted on a carrier 72. Additional description of these apparatus is found in U.S. Pat. No. 6,598,682.

The dynamic underbalance fluid surge can be performed relatively soon after perforating. For example, the surge can be activated within about one minute after perforating. In other aspects, the underbalance condition can be performed within (less than or equal to) about 10 seconds, one second, or 100 milliseconds, as examples, after perforating. The relative timing between perforation and dynamic underbalance is also applicable to other aspects described herein.

The characteristics (including the timing relative to perforating) of the dynamic underbalance surge can be based on characteristics (e.g., wellbore diameter, formation pressure, hydrostatic pressure, formation permeability, etc.) of the wellbore section in which the local low pressure condition is to be generated. Generally, different types of wellbores have different characteristics. In addition to varying timing of the underbalance surge relative to perforation, the volume of the low pressure chamber(s) of the surge tools 52 and the rate of fluid flow into the chamber(s) can be controlled.

According to another aspect of the invention, an underbalance condition may be created by using a choke line and a kill line that are part of subsea well equipment in subsea wells. In this implementation, the choke line, which extends from the subsea well equipment to the sea surface, may be filled with a low density fluid, while the kill line, which also extends to the sea surface, may be filled with a heavy wellbore fluid. Once the perforation gun tool string is run into the wellbore, a blow-out preventer (BOP), which is part of the subsea well equipment, may be closed, followed by opening of the choke line below the BOP and the closing of the kill line below the BOP. Opening of the choke line and closing of the kill line causes a reduction in the hydrostatic head in the wellbore to create an underbalance condition, causing gas liberation in the energized fluid and fluid surge out of perforation tunnels created below the sea bed or mudline. Perforating may be performed prior to disposal of the energized fluid or underbalance as disclosed herein. Additional tools and systems that may be used to implement subsea aspects of the invention are described in U.S. Pat. No. 6,598,682, assigned to the present assignee.

Figure 6:
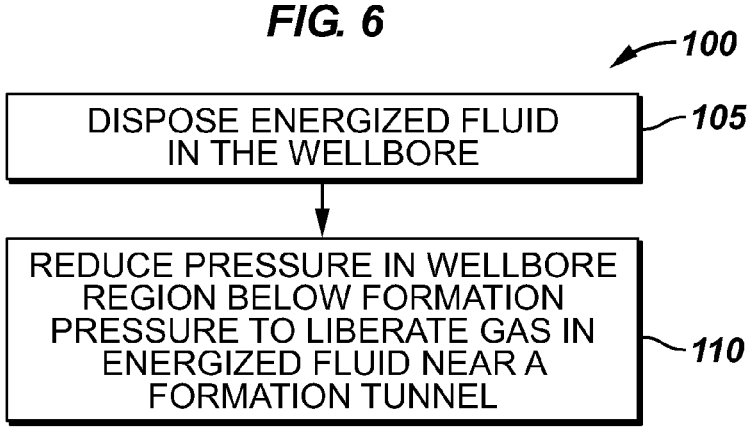
FIGS. 6-8 are flow charts of methods for use in a subsurface formation traversed by a wellbore in accordance with aspects of the invention.

FIG. 6 shows a flow chart of a method for use in a subsurface formation traversed by a wellbore according to the invention. In one aspect, a method 100 entails disposing an energized fluid in the formation using any technique or system as described herein at step 105. At step 110, the pressure in a region of the wellbore is reduced below pressure in the surrounding formation to liberate a gas in the energized fluid near a tunnel created in the formation. The wellbore pressure is manipulated using any technique as disclosed herein. This technique may be performed prior to casing the well or after casing and perforating, as disclosed herein.

Figure 7:
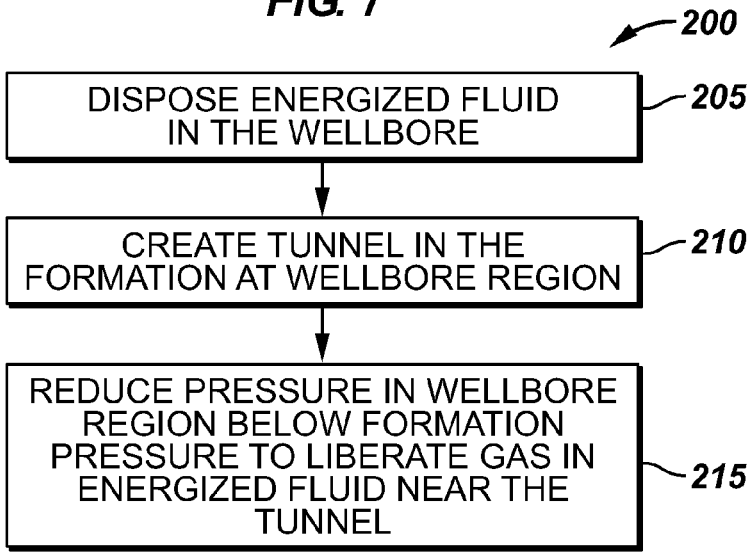

FIG. 7 shows a flow chart of another method for use in a subsurface formation traversed by a wellbore according to the invention. In one aspect, a method 200 entails disposing an energized fluid in the formation at step 205. Casing may also be disposed in the wellbore after disposal of the energized fluid, as disclosed herein. A tunnel is created in the formation at a region in the wellbore at step 210. The tunnel may be created using any technique as disclosed herein. If casing is used, the casing may be perforated using any techniques known in the art, as described herein. At step 215, the pressure in a region of the wellbore is reduced below pressure in the surrounding formation to liberate a gas in the energized fluid near the tunnel. The wellbore pressure is manipulated using any technique as disclosed herein.

Figure 8:
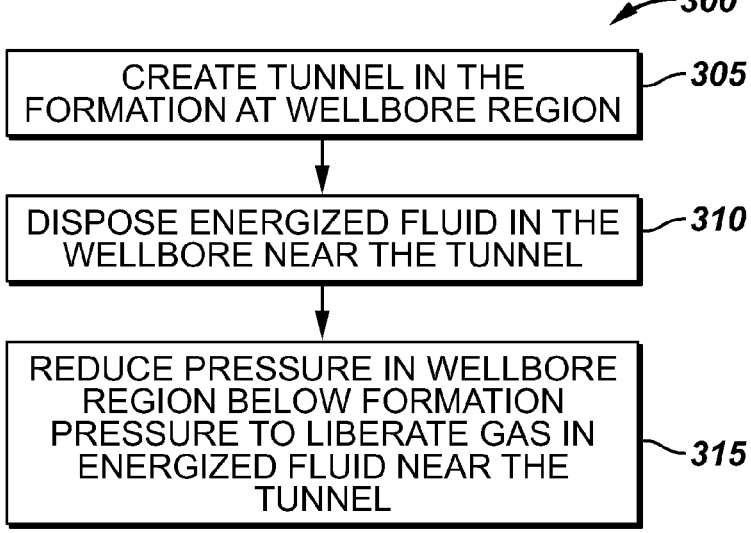

FIG. 8 shows a flow chart of another method for use in a subsurface formation traversed by a wellbore according to the invention. In one aspect, a method 300 entails creating a tunnel in the formation at a region in the wellbore at step 305. The tunnel may be created using any technique as disclosed herein. If casing is used in the wellbore, the casing may be perforated using any techniques known in the art, as described herein. An energized fluid is disposed in the formation near the tunnel at step 310. At step 315, the pressure in a region of the wellbore is reduced below pressure in the surrounding formation to liberate a gas in the energized fluid near the tunnel. The wellbore pressure is manipulated using any technique as disclosed herein.

While the present disclosure describes specific aspects of the invention, numerous modifications and variations will become apparent to those skilled in the art after studying the disclosure, including use of equivalent functional and/or structural substitutes for elements described herein. It will be appreciated by one skilled in the art that the invention can be applied in principal to all types of wells (e.g., cased wells, uncased wells, etc.). It will also be appreciated that, in operation, aspects of the invention may be implemented with conventional components, instruments, and apparatus (e.g., packers, tubing, valves, metal and/or composite casings/liners, etc.) as known in the art and not shown herein for clarity of the disclosure. All similar variations apparent to those skilled in the art are deemed to be within the scope of the invention as defined by the appended claims.

What is claimed is:

1. A method for use in a subsurface formation traversed by a wellbore, comprising:

disposing an energized fluid in a formation surrounding a region of the wellbore;

liberating a gas from the energized fluid disposed in the formation in response to reducing pressure in the region of the wellbore below pressure in the formation; and flowing debris from the formation into the wellbore in response to liberating the gas from the energized fluid.

2. The method of claim 1, further comprising creating a tunnel in the formation, wherein the energized fluid is disposed in the formation before creating the tunnel in the formation.

3. The method of claim 2, wherein reducing the pressure in the wellbore is performed when creating the tunnel in the formation.

4. The method of claim 3, wherein creating the tunnel in the formation comprises creating an opening in casing disposed in the wellbore.

5. The method of claim 4, wherein reducing the pressure in the region of the wellbore comprises opening at least one port to a sealed container disposed in the wellbore.

6. The method of claim 5, wherein the energized fluid comprises one selected from a liquid, a foam, and a liquefied gas.

7. The method of claim 1, wherein the energized fluid is disposed in the formation after creating the tunnel in the formation.

8. The method of claim 7, wherein reducing the pressure in the region of the wellbore comprises opening at least one port to a sealed container disposed in the wellbore.

9. The method of claim 8, wherein the energized fluid comprises one selected from a liquid, a foam, and a liquefied gas.

10. The method of claim 1, wherein the energized fluid comprises one selected from a liquid, a foam, and a liquefied gas.

* * * * *